US011113955B2

(12) United States Patent
Maehata

(10) Patent No.: US 11,113,955 B2
(45) Date of Patent: Sep. 7, 2021

(54) DATA COLLECTION SYSTEM

(71) Applicant: TOSHIBA MITSUBISHI-ELECTRIC INDUSTRIAL SYSTEMS CORPORATION, Chuo-ku (JP)

(72) Inventor: Noriyuki Maehata, Tokyo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 437 days.

(21) Appl. No.: 15/696,764

(22) Filed: Sep. 6, 2017

(65) Prior Publication Data

US 2017/0365164 A1 Dec. 21, 2017

Related U.S. Application Data

(63) Continuation of application No. PCT/JP2015/056648, filed on Mar. 6, 2015.

(51) Int. Cl.

*G08C 19/02* (2006.01)
*G08C 23/04* (2006.01)
*G08C 19/00* (2006.01)

(52) U.S. Cl.

CPC ..... *G08C 23/04* (2013.01); *G08C 19/00* (2013.01); *G08C 19/025* (2013.01)

(58) Field of Classification Search

CPC ..... G08C 19/00; G08C 19/025; G08C 23/04; H04B 10/25753; H04B 10/2507; G02B 6/2861; G02B 6/4274

USPC ..... 257/E21.525; 398/115, 118; 702/1, 79, 702/127, 188, 189

See application file for complete search history.

(56) References Cited

U.S. PATENT DOCUMENTS 5,105,292 A * 4/1992 Le Roy ..... H04Q 11/0001 370/478
6,091,525 A * 7/2000 Cundiff ..... H04B 10/077 398/1
6,473,556 B1 * 10/2002 Takeuchi ..... G01R 31/31917 385/147

(Continued)

FOREIGN PATENT DOCUMENTS

JP 2002-131366 * 5/2002
JP 2008-295298 12/2008

(Continued)

OTHER PUBLICATIONS

International Search Report dated Apr. 28, 2015 in PCT/JP2015/056648, filed on Mar. 6, 2015 (with English Translation).

(Continued)

*Primary Examiner* — Jeffrey P Aiello
(74) *Attorney, Agent, or Firm* — Xsensus LLP

(57) ABSTRACT

A data collection system includes sensors which are synchronized with each other and an optical signal distributor, wherein each of the sensors comprises a first delay unit which delays a second electrical signal for a first delay time set such that a sum of the first delay time and a first conversion time is same in all of the sensors, and the optical signal distributor comprises second delay units each of which delays a first electrical signal for a second delay time set such that all of sums of the second delay times and conversion times are same as each other.

19 Claims, 3 Drawing Sheets

(56) References Cited

U.S. PATENT DOCUMENTS

| | | | | |
|---|---|---|---|---|
| 6,747,269 | B2 * | 6/2004 | Watanabe | G01J 11/00 250/227.12 |
| 7,068,948 | B2 * | 6/2006 | Wei | H04B 10/508 398/184 |
| 2002/0005967 | A1 * | 1/2002 | Suzuki | H04J 3/14 398/79 |
| 2002/0005968 | A1 * | 1/2002 | Suzuki | H04J 14/0227 398/79 |
| 2002/0044316 | A1 * | 4/2002 | Myers | H04J 14/002 398/43 |
| 2002/0116092 | A1 | 8/2002 | Hamamatsu et al. | |
| 2003/0072051 | A1 * | 4/2003 | Myers | H04J 14/002 398/43 |
| 2003/0117126 | A1 * | 6/2003 | Rahmatian | G01R 15/241 324/96 |
| 2003/0128946 | A1 * | 7/2003 | Glingener | G01M 11/319 385/123 |
| 2009/0304389 | A1 * | 12/2009 | Joe | G02B 6/4214 398/115 |

FOREIGN PATENT DOCUMENTS

| | | | |
|---|---|---|---|
| JP | 2010-218056 | | 9/2010 |
| JP | 2010-218056 | A * | 9/2010 |

OTHER PUBLICATIONS

Written Opinion dated Apr. 28, 2015 in PCT/JP2015/056648, filed on Mar. 6, 2015.

* cited by examiner

DATA COLLECTION SYSTEM

CROSS REFERENCE TO RELATED APPLICATIONS

This application is a Continuation Application of PCT Application No. PCT/JP2015/056648, filed Mar. 6, 2015, the entire contents of which are incorporated herein by reference.

BACKGROUND OF THE INVENTION

1. Field of the Invention

Embodiments described herein relate generally to a data collection system for collecting measurement data by a plurality of sensors.

2. Description of the Related Art

In general, systems for monitoring the target by collecting measurement data obtained by a plurality of detectors provided in places distant from each other are known. For example, a monitoring device which monitors partial discharge generated in a high-voltage device based on the time of change in measurement data and the data is disclosed (see Patent Literature 1). A data collection system for collecting the measurement data of the same-time of sensors with high accuracy in consideration of transmission delay is disclosed (see Patent Literature 2).

However, when a plurality of sensors are synchronized with each other in consideration of transmission delay, the settings are dependent on the configuration of the system. Therefore, when the configuration of the system has been changed, the settings need to be changed to synchronize the sensors with each other. For example, even when a single sensor has been replaced, a setting operation for synchronization needs to be performed for the other sensors. Such a setting operation is troublesome.

CITATION LIST

Patent Literature

Patent Literature 1 JP 2002-131366 A
Patent Literature 2 JP 2010-218056 A

BRIEF SUMMARY OF THE INVENTION

Embodiments described herein aim to provide a data collection system capable of simplifying a setting operation for synchronizing a plurality of sensors.

In accordance with an aspect of the present invention, there is provided a data collection system. the data collection system comprises a plurality of sensors which are synchronized with each other; and an optical signal distributor, wherein each of the sensors comprises: a physical quantity measurement unit which measures a physical quantity; a first optical signal transmission unit which transmits a first optical signal to the optical signal distributor when the measured physical quantity satisfies a predetermined condition; a first signal converter which converts a second optical signal received from the optical signal distributor into a second electrical signal; a first delay unit which delays the second electrical signal obtained by the first signal converter for a first delay time set such that a sum of the first delay time and a first conversion time by the first signal converter is same in all of the sensors; and a data transmission unit which transmits the physical quantity measured at a time the condition is satisfied when the physical quantity satisfies the condition, and transmits the physical quantity measured a predetermined time before a receipt time of the second electrical signal when the data transmission unit receives the second electrical signal delayed by the first delay unit, and the optical signal distributor comprises: a plurality of second signal converters which convert the first optical signals output from the sensors into first electrical signals, respectively; a plurality of second delay units each of which delays the first electrical signal obtained by the corresponding second signal converter for a second delay time set such that all of sums of the second delay times and conversion times by the second signal converters are same as each other; and a second optical signal transmission unit which transmits the second optical signal to the first signal converter of each of the sensors when the second optical signal transmission unit receives the delayed first electrical signal from at least one of the second delay units.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Figure 1:
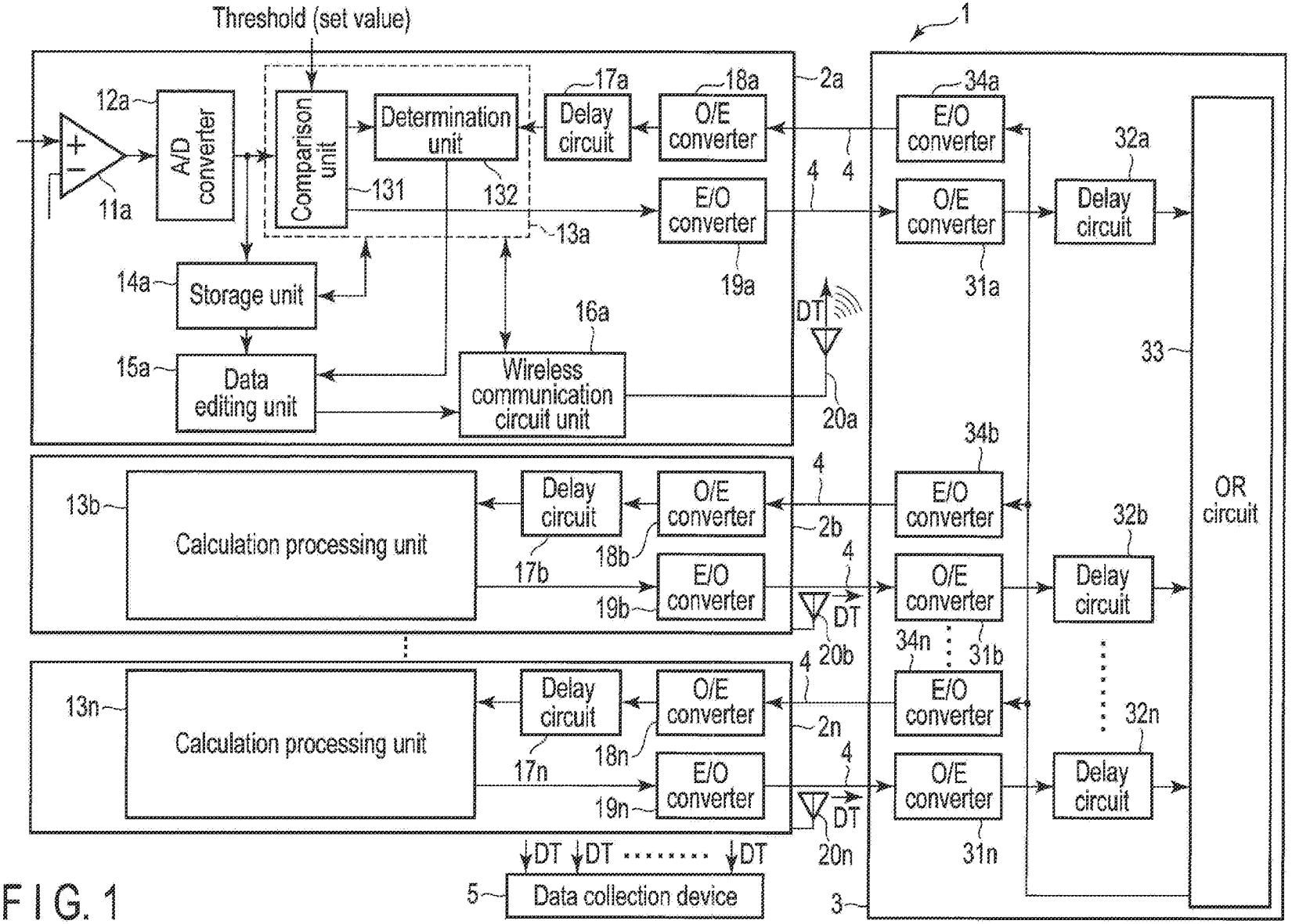
FIG. 1 is a configuration diagram showing the configuration of a data collection system according to a first embodiment of the present invention.

FIG. 1 is a configuration diagram showing the configuration of a data collection system 1 according to a first embodiment of the present invention. In the drawings, the same elements are denoted by like reference numbers, and redundant description is omitted.

The data collection system 1 comprises n sensors 2*a*, 2*b*, . . . 2*n*, an optical signal distributor 3, a plurality of optical transmission channels 4, and a data collection device 5. The number of sensors 2*a* to 2*n* is not particularly limited as long as it is greater than or equal to two. Each of sensors 2*a* to 2*n* is connected to the optical signal distributor 3 by two optical transmission channels 4 for transmission and reception. The optical transmission channels 4 are, for example, optical fibers. The data collection device 5 may not be an element included in the data collection system 1. The data collection device 5 may be provided in any place as long as it is capable of receiving measurement data DT from sensors 2*a* to 2*n*.

Sensors 2*a* to 2*n* are provided at measurement positions in or around an electronic device, etc. Sensors 2*a* to 2*n* measure a physical quantity such as voltage, current, electromagnetic waves by sampling a change in the physical quantity on the order of nanoseconds. Sensors 2*a* to 2*n* wirelessly transmit the measurement data DT of the measured physical quantity to the data collection device 5 which collects the measurement data DT. Sensors 2*a* to 2*n* transmit the measurement data DT based on two triggers, specifically, an internal trigger generated by a change in the physical quantity measured by itself and an external trigger generated by a change in the physical quantity measured by the other sensors 2*a* to 2*n*.

All of sensors 2*a* to 2*n* are structured in the same way except that the measurement target (for example, the measurement position or the physical quantity to be measured) differs. Here, a single sensor 2*a* is explained. The explanation of the other sensors 2*b* to 2*n* is omitted since they are structured in the same manner as that of sensor 2*a*.

Sensor 2*a* comprises an analog signal input unit 11*a*, an analog/digital converter 12*a*, a calculation processing unit 13*a*, a data storage unit 14*a*, a data editing unit 15*a*, a wireless communication circuit 16*a*, a delay circuit 17*a*, an O/E converter 18*a*, an E/O converter 19*a*, and a wireless communication antenna 20*a*. Sensor 2*a* further comprises structures necessary for synchronization, such as a reference oscillator.

An analog signal (electrical signal) indicating the physical quantity, which is measurement object of sensor 2*a*, is input to the analog signal input unit 11*a*. The analog signal input unit lla converts the input analog signal into an analog signal to be dealt with as a measurement value (measurement data), and outputs the analog signal to the analog/digital converter 12*a*.

The analog/digital converter 12*a* converts the measurement value of the analog signal input from the analog signal input unit 11*a* into a digital signal. The analog/digital converter 12*a* outputs the measurement value of the obtained digital signal to the calculation processing unit 13*a* and the data storage unit 14*a*.

The calculation processing unit 13*a* is configured to be realized when an element such as a central processing unit (CPU) is executed in accordance with a program, etc. The calculation processing unit 13*a* samples the measurement values (digital signals) output from the analog/digital converter 12*a* on the order of nanoseconds. The calculation processing unit 13*a* writes the sampled measurement values to the data storage unit 14*a*. Further, for example, the calculation processing unit 13*a* monitors and controls the components or elements provided in sensor 2*a*.

The data storage unit 14*a* is a memory which stores the sampled measurement values in chronological order. The capacity of the data storage unit 14*a* is sufficiently large so as to correspond to the function of sensor 2*a*. For example, the data storage unit 14*a* stores data in accordance with a ring buffer system.

The calculation processing unit 13*a* comprises a comparison unit 131 and a determination unit 132.

The measurement values input from the analog/digital converter 12*a* and sampled are input to the comparison unit 131. The comparison unit 131 compares the sampled measurement values with a predetermined threshold (set value). When a sampled measurement value exceeds the threshold, the comparison unit 131 outputs an internal trigger signal to the determination unit 132 and E/O converter 19*a*. Here, when a measurement value exceeds the threshold, an internal trigger signal is output. However, as long as an internal trigger signal is output when a measurement value satisfies a predetermined condition, the condition may be any condition. For example, an internal trigger signal may be output when a measurement value is less than the set value. Alternatively, an internal trigger signal may be output when the amount of change in the measurement values exceeds the set value.

The internal trigger signal output from the comparison unit 131 and an external trigger signal output from the other sensors 2*b* to 2*n* are input to the determination unit 132. When the determination unit 132 receives both an internal trigger signal and an external trigger signal, the determination unit 132 determines that the measurement value of the own sensor 2*a* exceeds the threshold (in other words, detection by the own sensor 2*a*). When the determination unit 132 receives an external trigger signal and does not receive an internal trigger signal, the determination unit 132 determines that the measurement value of the other sensors 2*b* to 2*n* exceeds the threshold (in other words, detection by the other sensors 2*b* to 2*n*). The determination unit 132 outputs, to the data editing unit 15*a*, a trigger signal for an instruction that data should be edited and transmitted together with the result of determination.

When the data editing unit 15*a* receives the result of determination and the trigger signal from the determination unit 132, the data editing unit 15*a* loads measurement data from the data storage unit 14*a* based on the result of determination. When the result of determination of the determination unit 132 indicates detection by the own sensor 2*a*, the data editing unit 15*a* loads the measurement data measured at the time of generation of the internal trigger signal from the data storage unit 14*a*. When the result of determination of the determination unit 132 indicates detection by the other sensors 2*b* to 2*n*, the data editing unit 15*a* loads, from the data storage unit 14*a*, measurement data measured a predetermined time before the receipt time of the external trigger signal. The data editing unit 15*a* adds information necessary for wireless transmission, such as a header and footer, to the measurement data loaded from the data storage unit 14*a*, and generates a packet for wireless transmission. The measurement data put by the data editing unit 15*a* in the packet may be any type of measurement data as long as the measurement data can be obtained from the data stored in the data storage unit 14*a*. For example, the measurement data put in the packet may be the instantaneous value or effective value of the applicable time. Alternatively, the measurement data may be waveform data obtained by, for example, editing the measurement values before and after the applicable time. The data editing unit 15*a* outputs the generated packet to the wireless communication circuit 16*a*.

The wireless communication circuit 16*a* outputs, via the wireless communication antenna 20*a*, the packet including the measurement data DT received from the data editing unit 15*a*. In this way, the measurement data DT of sensor 2*a* is wirelessly transmitted to the external data collection device 5.

O/E converter 18*a* receives an external trigger signal (optical signal) generated by detection of the other sensors 2*b* to 2*n* from the optical signal distributor 3 via the optical transmission channel 4. O/E converter 18*a* converts the received external trigger signal as an optical signal into an electrical signal. O/E converter 18*a* outputs the external trigger signal converted into the electrical signal to delay circuit 17*a*.

Delay circuit 17*a* outputs the external trigger signal input from O/E converter 18*a* to the determination unit 132 after a predetermined delay time. The delay time set in delay circuit 17*a* is determined based on the time required for the conversion by O/E converter 18*a* (conversion time).

E/O converter 19*a* converts an internal trigger signal input from the comparison unit 131 as an electrical signal into an optical signal. E/O converter 19*a* outputs the internal trigger signal converted into the optical signal to the optical signal distributor 3 via the optical transmission channel 4. The internal trigger signal output from E/O converter 19*a* is a signal to be dealt with as an external signal by the other sensors 2*b* to 2*n*.

When the optical signal distributor 3 receives the internal trigger signal as the optical signal output from arbitrary sensors 2*a* to 2*n*, the optical signal distributor 3 distributes the optical signal to all of the other sensors 2*a* to 2*n* as an external trigger signal.

The optical signal distributor 3 comprises n O/E converters 31*a* to 31*n*, *n* delay circuits 32*a* to 32*n*, an OR circuit 33, and n E/O converters 34*a* to 34*n*. The number of O/E converters 31*a* to 31*n*, the number of delay circuits 32*a* to 32*n* and the number of E/O converters 34*a* to 34*n* are equal to the number of sensors 2*a* to 2*n* in a corresponding manner. Here, O/E converter 31*a*, delay circuit 32*a* and E/O converter 34*a* corresponding to a single sensor 2*a* are mainly explained. The explanation of the other elements is omitted since they are structured in the same manner as that of the elements of sensor 2*a*.

O/E converter 31*a* receives a trigger signal (internal trigger signal) which is an optical signal from sensor 2*a*. O/E converter 31*a* converts the received trigger signal as an optical signal into an electrical signal. O/E converter 31*a* outputs the trigger signal converted into the electrical signal to delay circuit 32*a*.

Delay circuit 32*a* outputs the trigger signal input from O/E converter 31*a* to the OR circuit 33 after a predetermined delay time. The delay time set in delay circuit 32*a* is determined based on the time required for the conversion by O/E converter 31*a* (conversion time).

Trigger signals are input to the OR circuit 33 from all of delay circuits 32*a* to 32*n* corresponding to all of sensors 2*a* to 2*n*. The OR circuit 33 implements the OR operation of trigger signals from all of delay circuits 32*a* to 32*n*, and outputs the result of operation to E/O converters 34*a* to 34*n* corresponding to all of sensors 2*a* to 2*n*. Thus, when the OR circuit 33 receives a trigger signal from at least one of delay circuits 32*a* to 32*n*, the OR circuit 33 outputs trigger signals to all of E/O converters 34*a* to 34*n*.

E/O converter 34*a* receives a trigger signal which is an electrical signal from the OR circuit 33. E/O converter 34*a* converts the received trigger signal as an electrical signal into an optical signal. E/O converter 34*a* transmits the trigger signal converted into the optical signal to sensor 2*a* via the optical transmission channel 4 as an external trigger signal.

Figure 2:
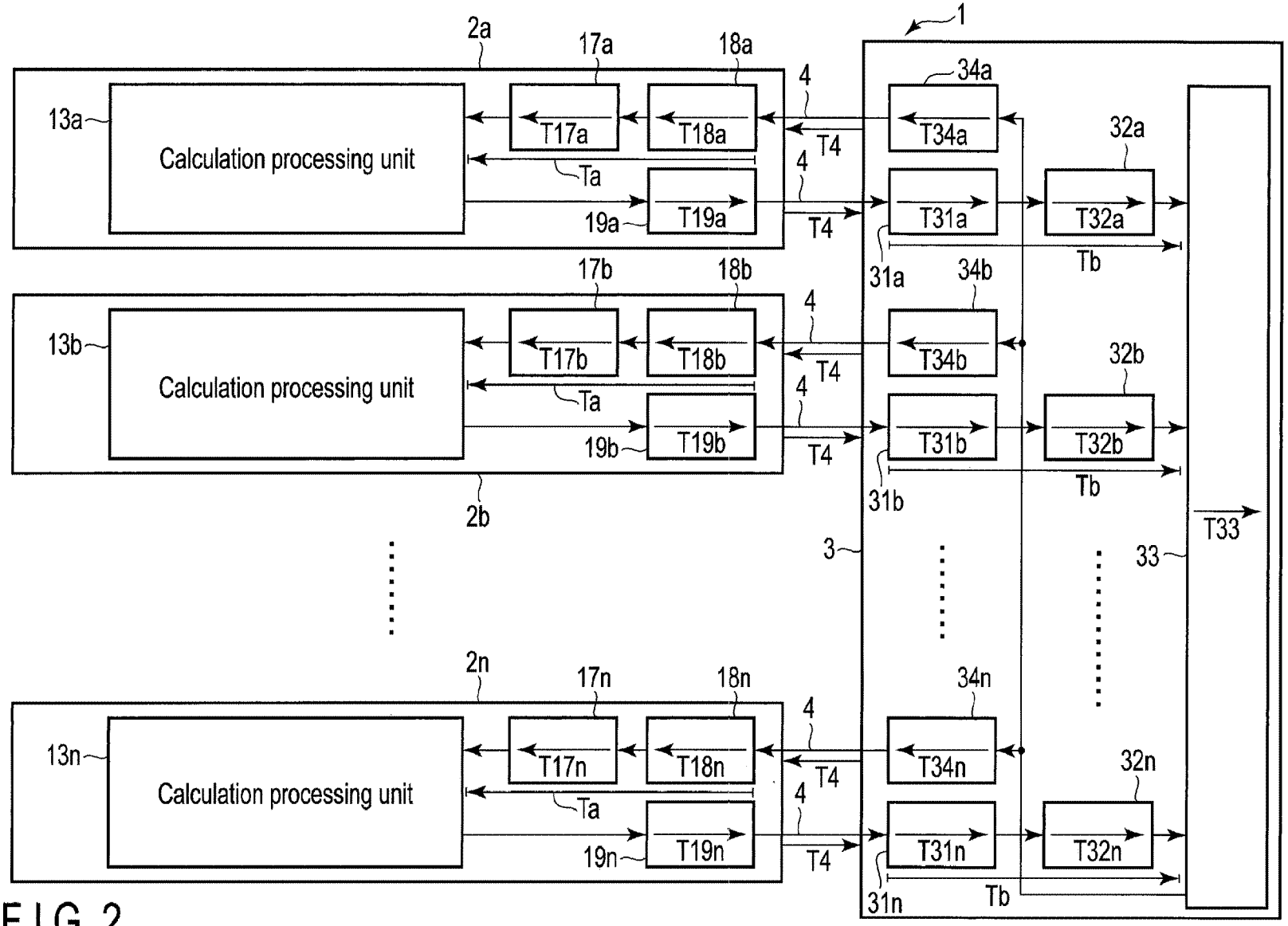
FIG. 2 is a configuration diagram showing the transmission time of trigger signals in the data collection system according to the present embodiment.

FIG. 2 is a configuration diagram showing the transmission time of trigger signals in the data collection system 1 according to the present embodiment.

This specification explains a method for determining delay times T17*a* to T17*n* set in delay circuits 17*a* to 17*n* of sensors 2*a* to 2*n*, and delay times T32*a* to T32*n* set in delay circuits 32*a* to 32*n* of the optical signal distributor 3.

All of conversion times T18*a* to T18*n* and T31*a* to T31*n* required for O/E converters 18*a* to 18*n* and 31*a* to 31*n* to convert an optical signal into an electrical signal differ depending on the converter. For example, conversion times T18*a* to T18*n* and T31*a* to T31*n* differ by approximately 100 nanoseconds. All of the conversion times required for E/O converters 19*a* to 19*n* and 34*a* to 34*n* to convert an electrical signal into an optical signal can be regarded as zero.

In sensors 2*a* to 2*n*, delay times T17*a* to T17*n* are set such that all of the sums of delay times T17*a* to T17*n* of delay circuits 17*a* to 17*n* and conversion times T18*a* to T18*n* of O/E converters 18*a* to 18*n* are the same time Ta. Time Ta is set so as to be greater than the individual difference in conversion times T18*a* to T18*n* of O/E converters 18*a* to 18*n*. Time Ta is a delay time required for an external trigger signal received in O/E converters 18*a* to 18*n* to reach calculation processing units 13*a* to 13*n* in sensors 2*a* to 2*n*.

In the optical signal distributor 3, delay times T32*a* to T32*n* are set such that all of the sums of delay times T32*a* to T32*n* of delay circuits 32*a* to 32*n* and conversion times T31*a* to T31*n* of O/E converters 31*a* to 31*n* are the same time Tb. Time Tb is set so as to be greater than the individual difference in conversion times T31*a* to T31*n* of O/E converters 31*a* to 31*n*. Time Tb is a delay time required for the internal trigger signals received from sensors 2*a* to 2*n* in O/E converters 31*a* to 31*n* of the optical signal distributor 3 to reach the OR circuit 33.

This specification explains delay time Td required for an internal trigger signal generated in sensor 2*b* to reach sensor 2*a* as an external trigger signal. Here, it is assumed that all of the optical transmission channels 4 connecting sensors 2*a* to 2*n* and the optical signal distributor 3 have the same length.

Delay time Td is shown by the following equation.

$$Td=T19b+T4+T31b+T32b+T33+T34a+T4+T18a+T17a \quad (1)$$

Here, time T4 is a time (signal transmission time) required for the transmission of an optical signal through the optical transmission channel 4. Time T33 is the operation processing time in the OR circuit 33. Time T19*b* is the conversion time of a signal in E/O convertor 19*b*. Time T34*a* is the conversion time of a signal in E/O converter 34*a*.

As described above, delay times T17*a* to T17*n* and T32*a* to T32 of delay circuits 17*a* to 17*n* and 32*a* to 32*n* are set. Thus, the following equations are established.

$$Ta=T17a+T18a=T17b+T18b=\ldots=T17n+T18n \quad (2)$$

$$Tb=T31a+T32a=T31b+T32b=\ldots=T31n+T32n \quad (3)$$

When equations (2) and (3) are substituted into equation (1), the following equation is obtained.

$$Td=T19b+T4+Tb+T33+T34a+T4+Ta \quad (4)$$

Here, conversion times T19*b* and T34*a* of E/O converters 19*b* and 34*a* can be regarded as zero. Thus, the following equation is obtained from equation (4).

$$Td=T4+Tb+T33+T4+Ta \quad (5)$$

Here, the operation processing time T33 of the OR circuit 33 is fixed. The signal transmission time T4 of the optical transmission channel 4 is determined by the length of the cable, and is fixed.

Time Ta and time Tb are also fixed. Thus, delay time Td is a fixed time.

For example, conditions are set to T4=10 [ns] (corresponding to an optical fiber cable of 2 m), T31*b*=34 [ns], T33=5 [ns], T18*a*=60 [ns], Ta=200 [ns] and Tb=150 [ns].

Delay time Td is obtained from equation (5) as follows.

$$Td=10+150+5+10+200=375 \text{ [ns]}$$

Under the above conditions, when sensor 2*a* receives a trigger signal generated in sensor 2*b*, sensor 2*a* obtains the measurement value measured 375 nanoseconds before the receipt time of the trigger signal such that sensor 2*a* is synchronized with the measurement value of sensor 2*b* at the generation time of the trigger signal.

At this time, delay time T32*b* of delay circuit 32*b* and delay time T17*a* of delay circuit 17*a* are obtained from equations (2) and (3) as follows.

$$T32b=Tb-T31b=150-34=116\ [\text{ns}] \quad (6)$$

$$T19a=Ta-T18a=200-60=140\ [\text{ns}] \quad (7)$$

Delay times T17*a* and T32*b* are obtained by determining times Ta and Tb and measuring conversion times T19*b* and T34*a* of E/O converters 19*b* and 34*a*. The obtained delay times T17*a* and T32*b* are set in delay circuits 17*a* and 32*b* before operation. This process is performed for all of delay circuits 17*a* to 17*n* and 32*a* to 32*n*.

In the present embodiment, a plurality of sensors 2*a* to 2*n* can be synchronized with each other with high accuracy. In this way, the data collection system 1 is capable of collecting measurement values determined as the same time with high accuracy from a plurality of sensors 2*a* to 2*n*.

For example, when delay circuits 17*a* to 17*n* and 32*a* to 32*n* are configured as delay elements which can be set in units of 0.1 nanoseconds, delay times T17*a* to T17*n* and T32*a* to T32*n* can be set in units of 0.1 nanoseconds. In this case, the accuracy of synchronization of measurement times among a plurality of sensors 2*a* to 2*n* can be set in units of 0.1 nanoseconds.

The data collection system 1 comprises sensors 2*a* to 2*n* comprising delay circuits 17*a* to 17*n*, and the optical signal distributor 3 comprising delay circuits 32*a* to 32*n*. Thus, even when an arbitrary combination of sensors 2*a* to 2*n* and the optical signal distributor 3 is selected, the setting operation of delay times T17*a* to T17*n* and T32*a* to T32*n* can be simplified. For example, when there is a need to replace any one of sensors 2*a* to 2*n* and the optical signal distributor 3, the setting operation for synchronization in the data collection system 1 can be completed by changing the settings for only delay circuits 17*a* to 17*n* or 32*a* to 32*n* provided in the new device (sensors 2*a* to 2*n* or the optical signal distributor 3).

Second Embodiment

Figure 3:
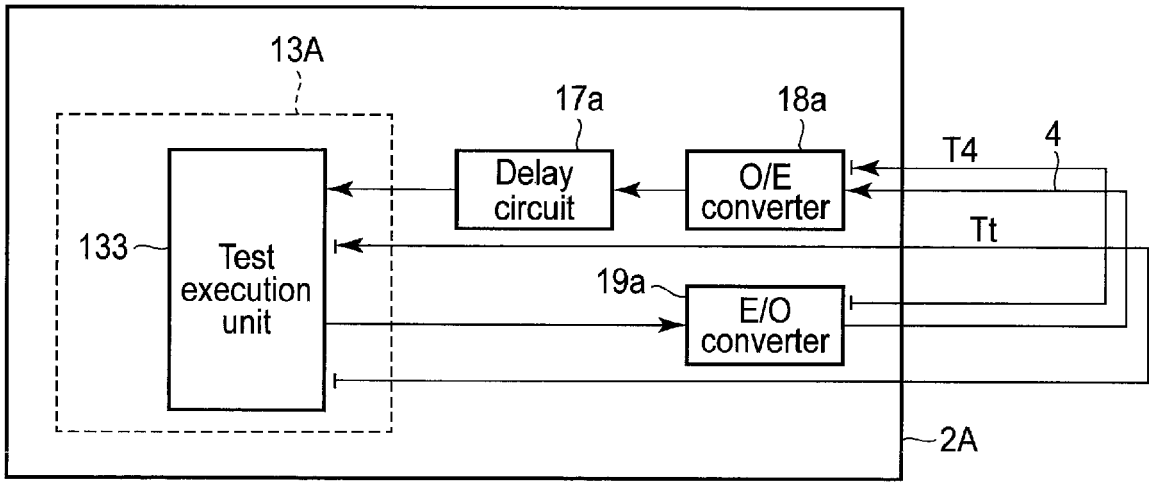
FIG. 3 is a configuration diagram showing the configuration of a sensor according to a second embodiment of the present invention.

FIG. 3 is a configuration diagram showing the configuration of a sensor 2A according to a second embodiment of the present invention.

The present embodiment comprises a data collection system 1 realized by providing a sensor 2A in place of each of sensors 2*a* to 2*n* in the data collection system 1 of the first embodiment shown in FIG. 1. The other structures are the same as those of the first embodiment.

Sensor 2A comprises a calculation processing unit 13A in place of calculation processing unit 13*a* in sensor 2*a* of the first embodiment shown in FIG. 1. The other structures of sensor 2A are the same as those of sensor 2*a* of the first embodiment.

Calculation processing unit 13A is realized by adding a test execution unit 133 to calculation processing unit 13*a* of the first embodiment. The other structures of calculation processing unit 13A are the same as those of calculation processing unit 13*a* of the first embodiment. For the sake of convenience, FIG. 3 shows only the test execution unit 133.

The test execution unit 133 performs a calculation process for executing a test mode (a function of measuring a signal delay time). The test execution unit 133 measures the signal delay time Tt between the output of a test signal and the reception in itself via an optical transmission channel 4. When the applied mode has been switched to a test mode, the test execution unit 133 performs a calculation process for carrying out a test. The applied mode may be switched between a normal mode executed in an operation state and a test mode in any manner. For example, the mode may be switched by either software or hardware. The mode may be artificially switched, or may be switched by automatically identifying an operation state or a test state.

Now, this specification explains a method for implementing a test for measuring the signal delay time Tt.

The test is carried out in a stand-alone state where sensor 2A is separated from the data collection system 1. The test may be conducted without separating sensor 2A from the data collection system 1.

A worker connects a terminal which outputs an internal trigger signal and a terminal to which an external trigger signal is input via the optical transmission channel 4 such that a trigger signal output from sensor 2A is received in itself. Specifically, the worker connects the output side of an E/O converter 19*a* and the input side of an O/E converter 18*a* via the optical transmission channel 4.

After the connection of the optical transmission channel 4, the worker performs an operation to cause sensor 2A to execute a test. By this operation, the test execution unit 133 outputs a test signal which is a trigger signal for a test.

The test signal output from the test execution unit 133 as an electrical signal is converted into an optical signal by E/O converter 19*a*. The test signal converted into the optical signal is output from E/O converter 19*a* to the optical transmission channel 4. O/E converter 18*a* receives the test signal via the optical transmission channel 4. O/E converter 18*a* converts the received test signal as the optical signal into an electrical signal, and outputs the electrical signal to a delay circuit 17*a*. Delay circuit 17*a* outputs the signal to the test execution unit 133 a predetermined delay time T17*a* after the reception of the test signal. Here, it is assumed that delay time T17*a* is set to zero in a test mode. Therefore, when delay circuit 17*a* receives a test signal, delay circuit 17*a* transmits the test signal without any delay. The test execution unit 133 measures the time between the transmission and the reception of the test signal.

In this case, the signal delay time Tt is shown by the following equation.

$$Tt=T19a+T4+T18a+T17a \quad (8)$$

Here, both conversion time T19*a* of E/O converter 19*a* and delay time T17*a* of delay circuit 17*a* are set to zero.

Thus, the following equation can be obtained from equation (8).

$$Tt=T4+T18a \quad (9)$$

The signal transmission time T4 of the optical transmission channel 4 is determined by obtaining the length of the optical transmission channel 4. Thus, when the signal delay time Tt is measured, conversion time T18*a* of O/E converter 18*a* is obtained.

The worker sets delay time T17*a* in delay circuit 17*a* based on the obtained conversion time T18*a* of O/E converter 18*a* such that the sum of delay time T17*a* of delay circuit 17*a* and conversion time T18*a* of O/E converter 18*a* is predetermined time Ta. Time Ta is a time used to realize a situation in which the sum of delay time T17*a* of delay circuit 17*a* and conversion time T18*a* of O/E converter 18*a* is the same in all of sensors 2A. Delay time T17*a* may be automatically set in delay circuit 17*a* in sensor 2A after the test by setting time Ta and the signal transmission time T4 of the optical transmission channel 4 in sensor 2A in advance.

In addition to the effects of the first embodiment, the following effect can be obtained by the present embodiment.

A test mode (a function of measuring a signal delay time) for measuring the signal delay time Tt between the transmission of a test signal and the reception of the returned test signal is provided in sensor 2A. Thus, in sensor 2A, delay time T17*a* of delay circuit 17*a* can be easily set.

The present invention is not limited to the embodiments described above but the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted from all of the constituent elements disclosed in the embodiments. The constituent elements described in different embodiments may be arbitrarily combined with each other.

What is claimed is:

1. A data collection system comprising:

a plurality of sensors which are synchronized with each other; and an optical signal distributor which is separate from the plurality of sensors and is connected to each of the plurality of sensors by a first optical transmission channel and a second optical transmission channel, wherein each of the plurality of sensors comprises:

a physical quantity measurement unit which measures a physical quantity;

a first optical signal transmission unit which transmits a first optical signal to the optical signal distributor via the first optical transmission channel, when the measured physical quantity satisfies a predetermined condition;

a first signal converter which converts a second optical signal into a second electrical signal, the second optical signal being received from the optical signal distributor via the second optical transmission channel;

a first delay unit which delays the second electrical signal obtained by the first signal converter for a first delay time, the first delay time being adjusted beforehand so that a sum of the first delay time and a first conversion time at the first signal converter is equal to a predetermined in-sensor transmission delay time, the predetermined in-sensor transmission delay time being a sum of another delay time at another delay unit and another conversion time at a corresponding another signal converter in any other sensors of the plurality of sensors and being set as a same value for all of the plurality of sensors; and a data transmission unit which transmits the physical quantity measured at a time the condition is satisfied when the physical quantity satisfies the condition, and transmits the physical quantity measured a predetermined time before a receipt time of the second electrical signal, when the data transmission unit receives the second electrical signal delayed by the first delay unit, and the optical signal distributor comprises:

a plurality of pairs of a second signal converter and a second delay unit, each of the plurality of pairs corresponding to each of the plurality of sensors, each second signal converter converting the first optical signal received from a corresponding sensor among the plurality of sensors via the first optical transmission channel into a first electrical signal, respectively, each second delay unit delaying the first electrical signal output by the corresponding second signal converter paired with the second delay unit for a second delay time, the second delay time being adjusted beforehand so that a sum of the second delay time at the second delay unit and a second conversion time at the corresponding second signal converter paired with the second delay unit is equal to a predetermined in-distributor transmission delay time, the predetermined in-distributor transmission delay time being set as a same value for all pairs of the plurality of pairs of the second signal converter and the second delay unit; and a second optical signal transmission unit which transmits the second optical signal to the first signal converter of each of the plurality of sensors via the second optical transmission channel, when the second optical signal transmission unit receives the delayed first electrical signal from at least one of the second delay units.

2. The data collection system of claim 1, wherein the data transmission unit performs wireless transmission.

3. The data collection system of claim 1, wherein the data transmission unit edits the measured physical quantity and performs transmission.

4. The data collection system of claim 1, wherein each of the plurality of sensors comprise:

a test signal output unit which outputs a test signal; and a time measurement unit which measures a time between output of the test signal by the test signal output unit and reception of an electrical signal after conversion by the first signal converter through transmission by the first optical signal transmission unit.

5. The data collection system of claim 1, further comprising a data collection device which receives the physical quantity measured by the sensors.

6. The data collection system of claim 1, wherein the predetermined in-sensor transmission delay time is a delay time required for an external trigger signal received at the first signal converter until calculation process is started in the sensor, the external trigger signal being output from the optical signal distributer.

7. The data collection system of claim 6, wherein the predetermined in-sensor transmission delay time is set so as to be greater than individual difference of the first conversion time corresponding to each first signal converter among the plurality of sensors.

8. The data collection system of claim 1, wherein the predetermined in-distributor transmission delay time is a delay time required for an internal trigger signal received at the second signal converter until calculation process is started in the optical signal distributer, the internal trigger signal being output from the at least one of the plurality of sensors.

9. The data collection system of claim 8, wherein the predetermined in-distributor transmission delay time is set so as to be greater than individual difference of the second conversion time corresponding to each second signal converter among the plurality of pairs of the second signal converter and the second delay unit.

10. A data collection method using a plurality of sensors which are synchronized with each other and an optical signal distributor, which is separate from the plurality of sensors and is connected to each of the plurality of sensors by a first optical transmission channel and a second optical transmission channel, wherein each of the plurality of sensors is configured to:

measure a physical quantity;

transmit a first optical signal to the optical signal distributor via the first optical transmission channel, when the measured physical quantity satisfies a predetermined condition;

convert a second optical signal into a second electrical signal into a second electrical signal, the second electrical signal being received from the optical signal distributor into a second electrical signal via the second optical transmission channel;

delay the obtained second electrical signal for a first delay time, the first delay time being adjusted beforehand so that a sum of the first delay time and a conversion time for conversion into the second electrical signal is equal to a predetermined in-sensor transmission delay time, the predetermined in-sensor transmission delay time being a sum of another delay time and another conversion time corresponding to the other delay time in any other sensors of the plurality of sensors and being set as a same value for all of the plurality of sensors; and transmit the physical quantity measured at a time the condition is satisfied when the physical quantity satisfies the condition, and transmit the physical quantity measured a predetermined time before a receipt time of the second electrical signal, when the delayed second electrical signal is received, and the optical signal distributor is configured to:

convert the first optical signal received from each of the plurality of sensors via the first optical transmission channel into a first electrical signal;

delay the output first electrical signal for a second delay time, the second delay time being adjusted beforehand so that a sum of the second delay time and a second conversion time for conversion into the first electrical signal is equal to a predetermined in-distributor transmission delay time, the predetermined in-distributor transmission delay time being set as a same value for all of pairs of the second conversion time and the second delay time, corresponding to the first optical signal output from each of the plurality of sensors; and transmit the second optical signal to each of the plurality of sensors via the second optical transmission channel, when the at least one delayed first electrical signal is received.

11. A data collection system comprising:

a plurality of sensors which are synchronized with each other, each of the plurality of sensors comprising a first circuitry; and an optical signal distributor, which is separate from the plurality of sensors and is connected to each of the plurality of sensors by a first optical transmission channel and a second optical transmission channel, comprising a second circuitry, wherein, the first circuitry is configured to measure a physical quantity, transmits a first optical signal to the optical signal distributor via the first optical transmission channel, when the measured physical quantity satisfies a predetermined condition, convert a second optical signal into a second electrical signal, the second optical signal being received from the optical signal distributor via the second optical transmission channel, delay the second electrical signal for a first delay time, the first delay time being adjusted beforehand so that a sum of the first delay time and a first conversion time required to convert the second optical signal into the second electrical signal is equal to a predetermined in-sensor transmission delay time, the predetermined in-sensor transmission delay time being a sum of another delay time and another conversion time in any other sensors of the plurality of sensors and being set as a same value for all of the plurality of sensors, transmit the physical quantity measured at a time the condition is satisfied when the physical quantity satisfies the condition, and transmit the physical quantity measured a predetermined time before a receipt time of the second electrical signal, when receiving the second electrical signal delayed for the first delay time, and wherein the second circuitry is configured to perform a plurality of pairs of a second signal conversion process and a second delay process, each of the pairs corresponding to each of the plurality of sensors, each second signal conversion process converting the first optical signal received from a corresponding sensor among the plurality of sensors via the first optical transmission channel into a first electrical signal, respectively, each second delay process delaying the first electrical signal output at the second signal conversion process paired with the second delay process for a second delay time, the second delay time being adjusted beforehand so that a sum of the second delay time and a second conversion time at the second conversion process is equal to a predetermined in-distributor transmission delay time, the predetermined in-distributor transmission delay time being set as a same value for all of the plurality of pairs of the second conversion process and the second delay process, and transmit the second optical signal to each of the plurality of sensors via the second optical transmission channel, when the second circuitry receives the delayed first electrical signal delayed for the second delay time.

12. The data collection system of claim 11, wherein the first circuitry is configured to perform wireless transmission.

13. The data collection system of claim 11, wherein the first circuitry is configured to edit the measured physical quantity and perform transmission.

14. The data collection system of claim 11, wherein the first circuitry is further configured to:

output a test signal; and measure a time between output of the test signal and reception of an electrical signal after conversion by the first circuitry, through transmission to the optical signal distributer.

15. The data collection system of claim 11, wherein the second circuitry is further configured to receive the physical quantity measured by at least one of the plurality of sensors.

16. The data collection system of claim 11, wherein the predetermined in-sensor transmission delay time is a delay time required for an external trigger signal received from the optical signal distributer until calculation process is started by the first circuitry in the sensor.

17. The data collection system of claim 16, wherein the predetermined in-sensor transmission delay time is set so as to be greater than individual difference of the first conversion time corresponding to each of the plurality of sensors.

18. The data collection system of claim 11, wherein the predetermined in-distributor transmission delay time is a delay time required for an internal trigger signal received from at least one of the plurality of sensors until calculation process is started by the second circuitry in the optical signal distributer.

19. The data collection system of claim 18, wherein the predetermined in-distributor transmission delay time is set so as to be greater than individual difference of the second conversion time corresponding to each second conversion process of the plurality of pairs of the second conversion process and the second delay process.

* * * * *